US009351531B1

(12) United States Patent
Bennett

(10) Patent No.: US 9,351,531 B1
(45) Date of Patent: May 31, 2016

(54) REFLECTIVE HEAD COVERING ASSEMBLY

(71) Applicant: Ed Bennett, Lebanon, CA (US)

(72) Inventor: Ed Bennett, Lebanon, CA (US)

( * ) Notice: Subject to any disclaimer, the term of this patent is extended or adjusted under 35 U.S.C. 154(b) by 273 days.

(21) Appl. No.: 14/053,160

(22) Filed: Oct. 14, 2013

(51) Int. Cl.
*A42B 1/24* (2006.01)
*A42B 3/04* (2006.01)
*A42B 3/06* (2006.01)

(52) U.S. Cl.
CPC ..... *A42B 3/0433* (2013.01); *A42B 1/24* (2013.01); *A42B 1/242* (2013.01); *A42B 1/244* (2013.01); *A42B 1/248* (2013.01); *A42B 3/061* (2013.01); *Y10T 24/3484* (2015.01)

(58) Field of Classification Search
CPC ..... A42B 1/24; A42B 1/242; A42B 1/244; A42B 1/248; A42B 3/061; A42B 3/0433; Y10T 24/3484; Y10T 24/3485; Y10T 24/31; Y10T 24/314
See application file for complete search history.

(56) References Cited

U.S. PATENT DOCUMENTS 2,838,868 A * 6/1958 Young ..... A01K 97/06 43/57.2
3,577,561 A 5/1971 Oshima
3,718,947 A * 3/1973 Huber ..... B66C 1/14 24/298
3,885,246 A 5/1975 Tung
4,008,949 A 2/1977 Luna
4,517,685 A * 5/1985 Lesley ..... A41D 13/01 2/170
D297,066 S 8/1988 Schonwetter et al.
D324,185 S 2/1992 Cross et al.
5,110,655 A 5/1992 Engler et al.
5,933,871 A * 8/1999 Kraft ..... A42B 1/067 2/181.4
6,305,028 B1 10/2001 Lin
6,526,596 B2 * 3/2003 Anderson ..... A42B 1/02 2/175.1
D495,118 S 8/2004 Sherman
6,982,633 B2 1/2006 Burdick
7,393,336 B2 * 7/2008 Sloot ..... A61F 5/0104 602/60
9,027,514 B2 * 5/2015 Kantor ..... A01K 11/00 119/857
2002/0002732 A1 1/2002 Lin
2005/0262616 A1 * 12/2005 Padgett ..... A42B 3/061 2/410
2007/0261212 A1 * 11/2007 Russell ..... A42B 3/0413 24/298
2011/0099691 A1 * 5/2011 Duwyn-Zylstra ..... A42B 1/22 2/175.1
2011/0158760 A1 * 6/2011 Dahl ..... D07B 1/18 410/96
2013/0180035 A1 * 7/2013 Lowther ..... A42B 1/24 2/422
2013/0205472 A1 * 8/2013 Jacobs ..... A42B 1/242 2/209.13

* cited by examiner

*Primary Examiner* — Khaled Annis

(57) ABSTRACT

A reflective head covering assembly increases visibility of a wearer in low-lighted environments. The assembly includes a head covering having a crown and a brim. The brim is coupled to and extends outwardly from a bottom edge of the crown. A strip has a reflective outwardly facing surface. An annular band is coupled to and extends around the crown. The strip is coupled to the band such that the outwardly facing surface faces away from the crown.

18 Claims, 3 Drawing Sheets

REFLECTIVE HEAD COVERING ASSEMBLY

BACKGROUND OF THE DISCLOSURE

Field of the Disclosure

The disclosure relates to head covering assemblies and more particularly pertains to a new head covering assembly for increasing visibility of a wearer in low-lighted environments.

SUMMARY OF THE DISCLOSURE

An embodiment of the disclosure meets the needs presented above by generally comprising a head covering having a crown and a brim. The brim is coupled to and extends outwardly from a bottom edge of the crown. A strip has a reflective outwardly facing surface. An annular band is coupled to and extends around the crown. The strip is coupled to the band such that the outwardly facing surface faces away from the crown.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
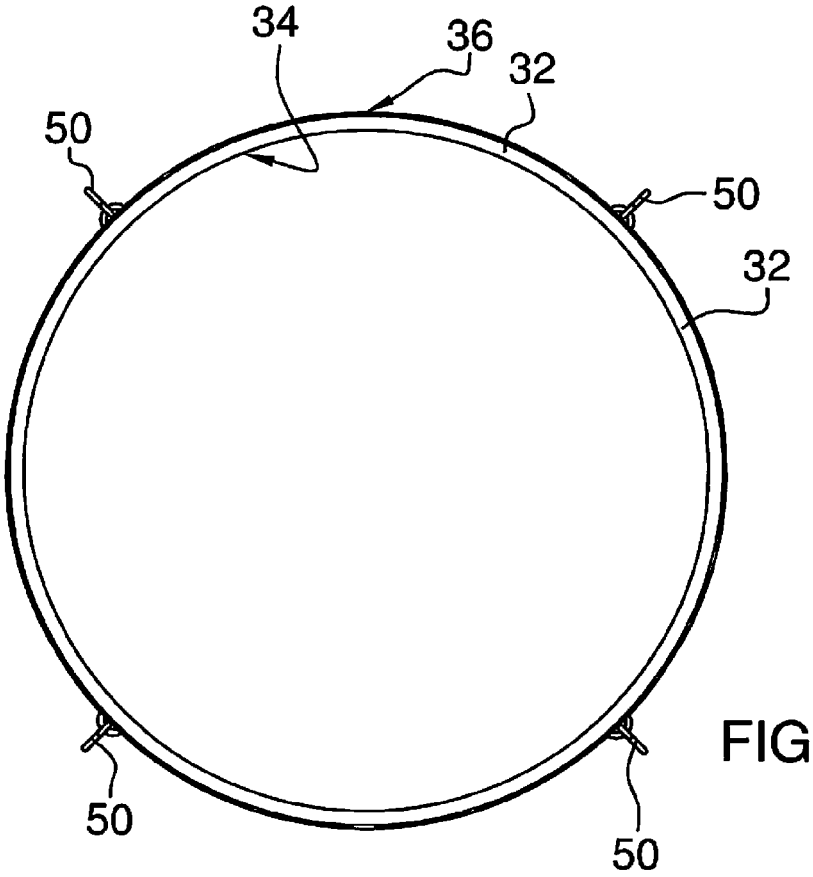
FIG. 1 is a top view of a reflective head covering assembly according to an embodiment of the disclosure.
Figure 2:
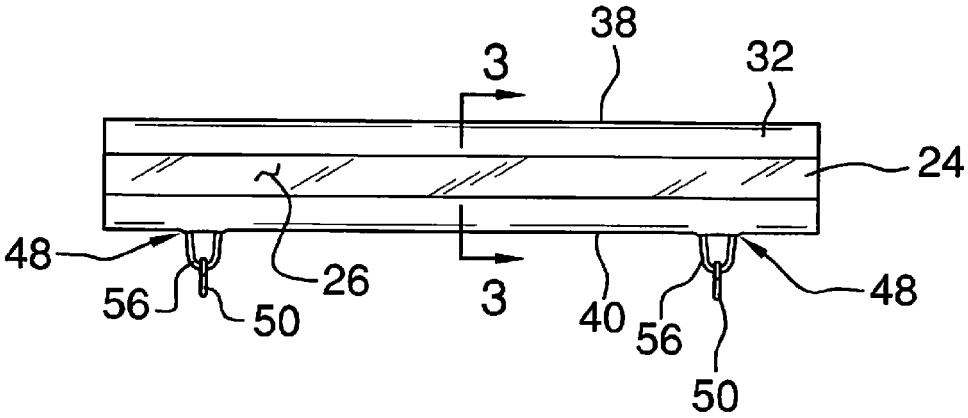
FIG. 2 is a front view of an embodiment of the disclosure.
Figure 3:
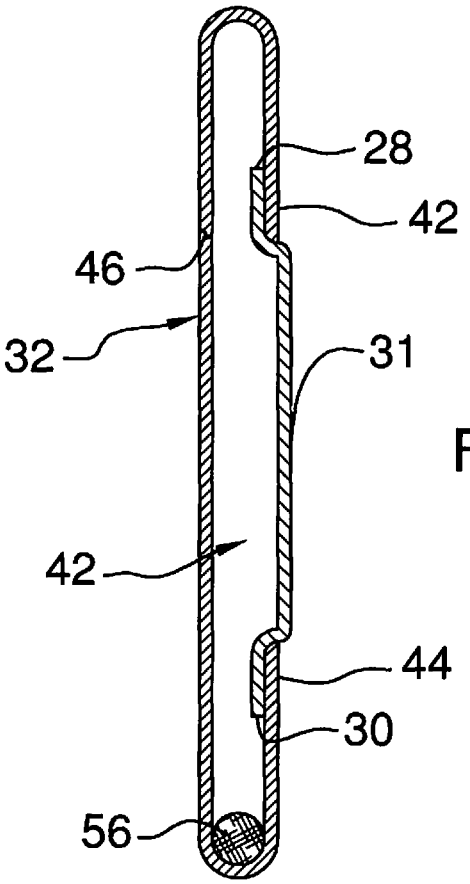
FIG. 3 is a cross-sectional view of an embodiment of the disclosure taken along line 3-3 of FIG. 2.
Figure 4:
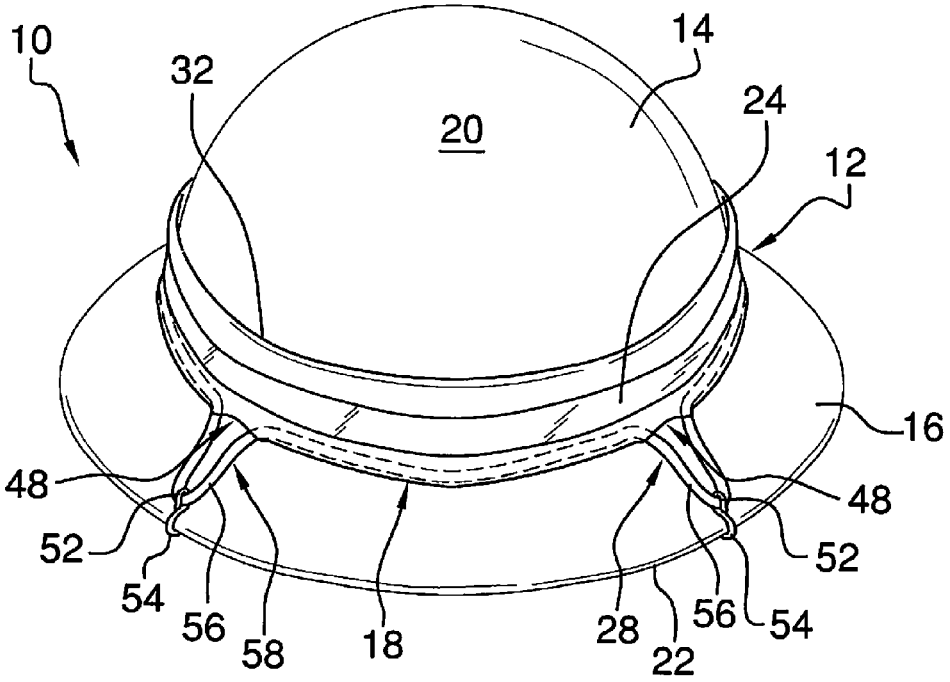
FIG. 4 is an in-use perspective view of an embodiment of the disclosure.
Figure 5:
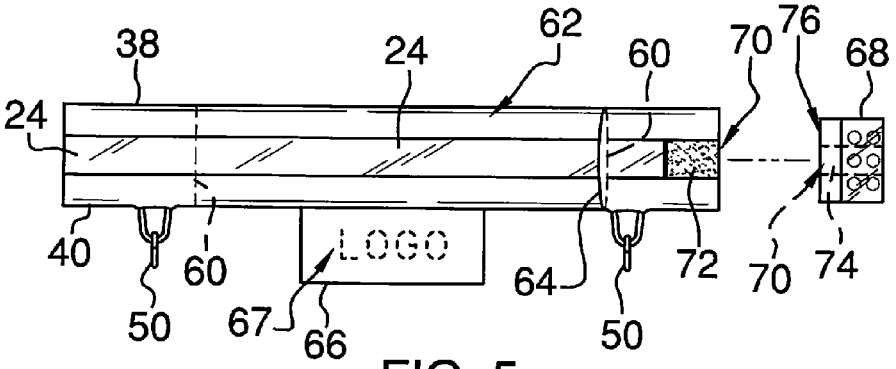
FIG. 5 is a front view of an alternative embodiment of the disclosure.

With reference now to the drawings, and in particular to FIGS. 1 through 5 thereof, a new head covering assembly embodying the principles and concepts of an embodiment of the disclosure and generally designated by the reference numeral 10 will be described.

As best illustrated in FIGS. 1 through 5, the reflective head covering assembly 10 generally comprises a head covering 12 including a crown 14 and a brim 16. The crown 14 has a bottom edge 18 and a convexly arcuate outer surface 20. The brim 16 is coupled to and extends outwardly from the bottom edge 20. The brim 16 may extend an entire circumference around the bottom edge 20. The brim 16 has an outer edge 22 positioned distally relative to the crown 14. The head covering 12 may comprise a conventional hard hat commonly used in the construction industry.

A strip 24 has a reflective outwardly facing surface 26. The strip 24 has a top end 28, a bottom end 30 and a medial section 31 extending between the top 28 and bottom 30 ends. An annular band 32 is removably coupled to the crown 14. The band 32 is extendable around the crown 14 proximate the bottom edge 20. The band 32 has an inner surface 34, an exterior surface 36, an upper edge 38 and a lower edge 40 defining an interior space 42 of the band 32. The strip 24 is coupled to the band 32. In particular, a first end 42 of the band 32 may overlap the strip 24 proximate the top end 28 of the strip 24. Similarly, a second end 44 of the band 32 may overlap the strip 24 proximate the bottom end 30 of the strip 24. The band 32 may be comprised of an elastomeric material 46. A plurality of openings 48 is positioned in the band 32. The openings 48 may extend into the lower edge 40 of the band 32.

A plurality of retaining members 50 is configured to retain the band 32 on the head covering 12. Each of the retaining members 50 comprises a hook having an arcuate upper section 52 coupled to an arcuate lower section 54. Each of the arcuate lower sections 54 is selectively positionable to engage the outer edge 22 of the brim 16. A strap 56 extends through the interior space 42 of the band 32. The strap 56 extends the entire circumference around the band 32. The strap 56 may be comprised of an elastomeric material. The strap 56 forms a plurality of loops 58 that extend outwardly of each of the openings 48 and engage each of the arcuate upper sections 52.

A pair of spaced stitch lines 60 couples the inner 34 and exterior 36 surfaces of the band 32. The stitch lines 60 define a pocket 62 positioned in the interior space 42 of the band 32. The pocket 62 extends between an adjacently positioned pair of the retaining members 50. A slit 64 is positioned in the band 32 wherein the slit 64 defines an access opening into the pocket 62. The pocket 62 may be used to store pencils or like therein. A tab 66 is coupled to the band 32. The tab 66 may extend downwardly from the lower edge 40 of the band 32 and may be positioned below the pocket 62. Decorative indicia 67, such as logos or the like, may be positioned on the tab 66.

A flashlight 68 is removably coupled to the band 32. A fastener 70 releasably couples the flashlight 68 and the band 32. The fastener 70 includes a first mating member 72 coupled to the strip 24 and a second mating member 74 coupled to the flashlight 68. The first mating member 72 may be positioned proximate the slit 64. The second mating member 74 may be coupled to a back side 76 of the flashlight 68. The fastener 70 may comprise a hook and loop coupler or another conventional type of fastener.

In use, the band 32 is slid onto the crown 14 above the brim 16. The band 32 is secured to the head covering 12 by attaching the strap 56 to the retaining members 50 and the retaining members 50 to the outer edge 22 of the brim 16. The head covering 12 is positioned on the user's head in a conventional manner to cover the wearer's head. However, the reflective outwardly facing surface 26 of the strip 24 increases visibility of the wearer in low-lighted conditions in order to create a safer working environment. The band 32 can be removed from the head covering 12 as desired by removing the retaining members and sliding the band 32 off of the crown 14.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A reflective head covering assembly comprising:

a head covering including a crown and a brim, said brim being coupled to and extending outwardly from a bottom edge of said crown;

a strip having a reflective outwardly facing surface, said strip having a top end and a bottom end; and an annular band coupled to and extending around said crown, said strip being coupled to said band such that said outwardly facing surface faces away from said crown, a first end of said band overlapping said strip proximate said top end of said strip, a second end of said band overlapping said strip proximate said bottom end of said strip.

2. The assembly of claim 1, further comprising:

wherein said band is removably coupled to said crown; and a plurality of retaining members coupling said band to said head covering wherein said retaining members are configured to retain said band on said head covering.

3. The assembly of claim 2, further comprising each of said retaining members comprising a hook having an arcuate upper section coupled to an arcuate lower section, each of said arcuate lower sections being selectively positionable to engage an outer edge of said brim.

4. The assembly of claim 2, further comprising:

said band having an inner surface, an exterior surface, an upper edge and a lower edge defining an interior space of said band; and a strap extending through said interior space of said band, said strap extending an entire circumference around said band.

5. The assembly of claim 1, further comprising said band being comprised of an elastomeric material.

6. The assembly of claim 1, further comprising:

a flashlight removably coupled to said band; and a fastener releasably coupling said flashlight and said band, said fastener including a first mating member coupled to said strip and a second mating member coupled to said flashlight.

7. The assembly of claim 6, further comprising said fastener comprising a hook and loop coupler.

8. The assembly of claim 1, further comprising:

said crown having a bottom edge and a convexly arcuate outer surface, said brim extending an entire circumference around said bottom edge, said brim having an outer edge being positioned distally relative to said crown;

said strip having a medial section extending between said top and bottom ends;

said annular band being removably coupled to said crown, said band being extendable around said crown proximate said bottom edge, said band having an inner surface, an exterior surface, an upper edge and a lower edge defining an interior space of said band, said band being comprised of an elastomeric material;

a plurality of openings positioned in said band, said openings extending into said lower edge of said band;

a plurality of retaining members coupling said band to said head covering wherein said retaining members are configured to retain said band on said head covering, each of said retaining members comprising a hook having an arcuate upper section coupled to an arcuate lower section, each of said arcuate lower sections being selectively positionable to engage said outer edge of said brim;

a strap extending through said interior space of said band, said strap extending an entire circumference around said band, said strap being comprised of an elastomeric material, said strap forming a plurality of loops, each of said loops extending outwardly of an associated one of said openings and engaging an associated one of said arcuate upper sections;

a pair of spaced stitch lines coupling said inner and exterior surfaces of said band, said stitch lines defining a pocket positioned in said interior space of said band, said pocket extending between an adjacently positioned pair of said retaining members;

a slit positioned in said band wherein said slit defines an access opening into said pocket;

a tab coupled to said band and extending downwardly from said lower edge of said band, said tab being positioned below said pocket;

a flashlight removably coupled to said band; and a fastener releasably coupling said flashlight and said band, said fastener including a first mating member coupled to said medial section of said strip and a second mating member coupled to a back side of said flashlight, said first mating member being positioned proximate said slit, said fastener comprising a hook and loop coupler.

9. The assembly of claim 8, further comprising:

said strip having a top end, a bottom end and a medial section extending between said top and bottom ends;

said outwardly facing surface being configured to face away from said crown, a first end of said band overlapping said strip proximate said top end of said strip, a second end of said band overlapping said strip proximate said bottom end of said strip;

said openings extending into said lower edge of said band;

each of said retaining members comprising a hook having an arcuate upper section coupled to an arcuate lower section, each of said arcuate lower sections being configured to selectively engage an outer edge of said brim of the head covering;

said strap being comprised of an elastomeric material, each of said loops engaging an associated one of said arcuate upper sections;

said pocket extending between an adjacently positioned pair of said retaining members;

a tab coupled to said band and extending downwardly from said lower edge of said band, said tab being positioned below said pocket; and said first mating member being coupled to said medial section of said strip and said second mating member coupled to a back side of said flashlight, said first mating member being positioned proximate said slit.

10. A reflective head covering assembly comprising:

a head covering including a crown and a brim, said brim being coupled to and extending outwardly from a bottom edge of said crown;

a strip having a reflective outwardly facing surface;

an annular band coupled to and extending around said crown, said strip being coupled to said band such that said outwardly facing surface faces away from said crown;

wherein said band is removably coupled to said crown;

a plurality of retaining members coupling said band to said head covering wherein said retaining members are configured to retain said band on said head covering;

said band having an inner surface, an exterior surface, an upper edge and a lower edge defining an interior space of said band;

a strap extending through said interior space of said band, said strap extending an entire circumference around said band;

a plurality of openings positioned in said band; and wherein said strap forms a plurality of loops, each of said loops extending outwardly of an associated one of said openings and engaging an associated one of said retaining members.

11. A reflective head covering assembly comprising:

a head covering including a crown and a brim, said brim being coupled to and extending outwardly from a bottom edge of said crown;

a strip having a reflective outwardly facing surface;

an annular band coupled to and extending around said crown, said strip being coupled to said band such that said outwardly facing surface faces away from said crown;

wherein said band has an inner surface, an exterior surface, an upper edge and a lower edge defining an interior space of said band;

a pair of spaced stitch lines coupling said inner and exterior surfaces of said band, said stitch lines defining a pocket positioned in said interior space of said band; and a slit positioned in said band wherein said slit defines an access opening into said pocket.

12. A reflective head covering assembly comprising:

a strip having a reflective outwardly facing surface; and an annular band configured for coupling to and extending around a crown of a head covering, said strip being coupled to said band, said band having an inner surface, an exterior surface, an upper edge and a lower edge defining an interior space of said band;

a pair of spaced stitch lines coupling said inner and exterior surfaces of said band, said stitch lines defining a pocket positioned in said interior space of said band; and a slit positioned in said band wherein said slit defines an access opening into said pocket.

13. The assembly of claim 12, further comprising a plurality of retaining members coupled to said band, said retaining members being configured for coupling said band to the head covering wherein said retaining members are configured to retain said band on a brim of the head covering.

14. The assembly of claim 13, further comprising:

said band having an inner surface, an exterior surface, an upper edge and a lower edge defining an interior space of said band; and a strap extending through said interior space of said band, said strap extending an entire circumference around said band.

15. The assembly of claim 14, further comprising:

a plurality of openings positioned in said band; and wherein said strap forms a plurality of loops, each of said loops extending outwardly of an associated one of said openings and engaging an associated one of said retaining members.

16. The assembly of claim 12, further comprising:

a flashlight removably coupled to said band; and a fastener releasably coupling said flashlight and said band, said fastener including a first mating member coupled to said strip and a second mating member coupled to said flashlight.

17. The assembly of claim 16, further comprising said fastener comprising a hook and loop coupler.

18. The assembly of claim 12, further comprising said band being comprised of an elastomeric material.

* * * * *